United States Patent [19]

Reeve et al.

[11] Patent Number: 4,726,842

[45] Date of Patent: Feb. 23, 1988

[54] METALLIC MATERIALS RE-INFORCED BY A CONTINUOUS NETWORK OF A CERAMIC PHASE

[75] Inventors: Martin R. Reeve, Beaconsfield; Adam J. Gesing; Graham Stratford, both of Kingston, all of Canada

[73] Assignee: Alcan International Limited, Montreal, Canada

[21] Appl. No.: 805,315

[22] Filed: Dec. 3, 1985

Related U.S. Application Data

[63] Continuation of Ser. No. 565,907, Dec. 27, 1983, abandoned.

[30] Foreign Application Priority Data

Dec. 30, 1982 [GB] United Kingdom ..... 8236932

[51] Int. Cl.[4] ..... C22C 29/14

[52] U.S. Cl. ..... 75/244; 419/12; 419/13; 419/45; 428/551; 428/568; 428/539.5

[58] Field of Search ..... 419/12, 13, 45; 75/244; 428/551, 568, 539.5

[56] References Cited

U.S. PATENT DOCUMENTS

| | | | |
|---|---|---|---|
| 3,981,062 | 9/1976 | Moskowitz et al. | 75/244 |
| 4,327,156 | 4/1982 | Dillon et al. | 419/12 |
| 4,383,855 | 5/1983 | Aaron et al. | 419/19 |
| 4,419,130 | 12/1983 | Slaughter | 75/246 |
| 4,557,893 | 12/1985 | Jatkar et al. | 419/12 |
| 4,585,618 | 4/1986 | Fresnel et al. | 419/19 |
| 4,605,440 | 8/1986 | Halverson et al. | 419/12 |

*Primary Examiner*—Stephen J. Lechert, Jr.

*Attorney, Agent, or Firm*—Cooper, Dunham, Griffin & Moran

[57] ABSTRACT

A cermet material comprises an intergrown network of a minor proportion of ceramic such as $TiB_2$ in a metal matrix such as Al. The cermet is prepared by forming a minor proportion by weight of a ceramic phase in situ in a molten metal phase and holding the mixture of elevated temperature for a time to effect formation of an intergrown ceramic network.

7 Claims, No Drawings

METALLIC MATERIALS RE-INFORCED BY A CONTINUOUS NETWORK OF A CERAMIC PHASE

This is a continuation of application Ser. No. 565,907, filed Dec. 27, 1983.

The present invention relates to materials which may be exposed to an environment containing aggressive liquid or gaseous media at high temperature.

Ceramic-metal mixtures, known as cermets, comprise one class of materials particularly useful in this field. In the present state of the art, cermets consist of a minor proportion of a metal phase intimately dispersed on a micro-structural scale within a major proportion e.g. 60–90% by weight of a ceramic phase, both phases being randomly shaped. The term "ceramic" is understood to include oxides, silicides, borides, nitrides and carbides. The useful properties of such metal-ceramic combinations are different from those of either phase alone. The metal improves the strength, ductility, toughness and electrical conductivity and allows for sintering at lower temperatures than would be possible for a ceramic alone.

The ceramic phase provides hardness, abrasion resistance and improves the mechanical properties at high temperature. Hence the major uses of cermets stem from exploring these improved properties. Cemented carbides are widely used as abrasives and dispersion strengthened alloys such as T. D. Nickel are used as high temperature structural materials.

Such materials are conventionally made by powder metallurgical methods well known in the art, i.e. by preparing and mixing individual metal and ceramic powders, pressing into the required shape in a die, and subjecting to a sintering heat treatment to bond the particles and develop the required structural integrity of the compact.

High temperature structural integrity can be achieved by either utilising a refractory metal as a bonding phase or arranging the sintering schedule so that direct ceramic-to-ceramic bonds are formed.

Although useful, state-of-the-art materials have certain disadvantages. In the case of non-oxides, the ceramics are expensive and their major proportion contributes to the high cost of the material. Cermets containing a high proportion of oxides or nitrides have very low electrical conductivity and are unsuitable for application as electrical conductors in a high temperature environment.

The present invention resides in the discovery that materials with good high temperature properties (structural integrity at high temperatures) comprise a minor proportion (50% by weight and downwards) of a ceramic in a major proportion (50% by weight and upwards) of a metal matrix, the amount of ceramic formed being sufficient to develop a microstructure of an intergrown network of the ceramic in the metal matrix. In such materials, the major proportion of metal provides greatly increased toughness at low temperatures compared with state-of-the-art materials having a high ceramic content whilst at the same time the intergrown network of ceramic particles provides some structural integrity even above the melting point of the metal phase. In the case of non-oxides they are less expensive, because the less expensive metal phase comprises the major proportion. They can have the further advantage of having a good electrical conductivity due to the integrity of the metal phase, which can be comprised of a high conductivity metal such as Al.

The ceramic content of the composite material is preferably from 10% to 45% by weight.

The ceramic network may be formed in situ in the metal, e.g. by reaction between a component of the molten metal phase and a ceramic precursor or precursors introduced into it.

Thus the molten metal phase for this purpose should be reactive with a precursor, such as a carbon-, boron- and/or nitrogen-bearing componenent (or carbon, boron and/or nitrogen in elemental form) to yield a product having ceramic characteristics.

The criteria for selection of the metal phase may be defined as a melting temperature within the capability of industrial melting furnaces (1700°–1800° C.) and good toughness in the case condition (i.e. combination of ductility and strength) in addition to reactivity with a ceramic precursor or precursors. The metal phase may be either in elemental or alloy form. In most instances the reactive metal component will be selected from one or more of Al, Ti, Cr, V, Nb, Zr, Hf. These may be alloyed, for example, with Fe or Ni.

In addition to C, B, or $N_2$ (as gas) in elemental form, ceramic precursors in combined form may be employed and may be selected according to the melting point and reactivity of the metal phase in relation to the selected precursor. Thus C may be used as a solid compound, such as hexachlorethane, for addition to lower melting metals, for example to Al-Ti alloy to form titanium carbide in situ. B may be added to higher melting point metals in the form of ferroboron containing up to 20% B.

When the ceramic is formed in situ by reaction between an added precursor and a component of an alloy, the molten alloy should be maintained at a temperature above the liquidus to avoid precipitation of any of the alloying components.

In one particular aspect the present invention relates to materials which may be exposed to molten Al at the high temperatures associated with electrolytic reduction cells, without disintegration. Such materials may be employed as packing materials for stabilisation of the liquid metal cathode of an electrolytic reduction cell. The materials may be employed also as conductor material which is subjected to high temperatures e.g. above the melting point of aluminium, but is not necessarily in direct contact with molten aluminium.

One such material within the scope of the present invention is a composite of aluminium metal and titanium diboride. In this material the ceramic is a high cost component and it is the objective to employ as small a proportion of such ceramic in the cermet as is consistent with obtaining adequate mechanical strength at the operating temperature and for the intended purpose.

It is well known that molten aluminium is extremely aggressive in relation to nearly all electro-conductive materials. In practice heretofore carbon has been the sole solid material employed as a conductor in direct contact with molten aluminium to establish a current path between the molten aluminium cathode of a reduction cell and the cathode bus bar.

In the search for greater efficiency in terms of electrical energy requirements per tonne of product, it has already been proposed to employ cathode cell linings made from titanium boride, particularly for cells provided with so-called "drained cathode" structures. However the cost of titanium diboride is high and the object of this aspect of the present invention is to produce a lower cost material which has conductivity equal to or greater than that of solid titanium diboride and has good resistance to attack by molten aluminium. As will be apparent from the above in its intended uses advantage will not necessarily be taken of both high conductivity and resistance to attack by molten aluminium.

One such material, according to the present invention, comprises a minor proportion by weight of particles of $TiB_2$ (or diboride of other transition metal, such as Zr, Hf, Nb, V, and Cr,) forming an open-cell continuous network, the interstices in such diboride network being filled with aluminium metal. It is found that such a network of diboride particles may be established when the composite contains as little as 10% diboride by weight. However it is preferred for the diboride ceramic/metal cermet of the invention to include at least 20% diboride by weight. The diboride content generally does not exceed 30% by weight.

U.S. Pat. No. 3,037,857 describes Al-based alloys which are stiffer than ordinary Al. These contain up to 50% by volume of titanium diboride and are made by dispersing pre-formed particulate titanium diboride in powdered solid Al or an Al melt. On heating, molten Al wets and flows completely in and around each particle of titanium diboride producing thereby the desired dispersion.

One disadvantage of the U.S. patent is that titanium diboride is difficult and expensive to produce in a pure particulate state. The material of the present invention is more easily and cheaply produced by adding a (relatively cheap) ceramic precursor to an Al melt so as to form titanium diboride in situ.

Another advantage of the material of the present invention is that the titanium diboride is present as an open cell continuous network, and not as discrete particles as in the U.S. patent. This network structure is a direct result of formation of the ceramic phase in situ in the molten Al. It is believed that titanium diboride particles suspended in the melt are pushed to the boundaries of Al grains as these grow within the melt, to form cells in the microstructure. The titanium diboride particles then form an inter-cellular network. Above the melting point of Al, it is believed that this network helps the material to keep its shape at lower titanium diboride contents than for any products in which Al and preformed titanium diboride are uniformly interdispersed. Below the melting point of Al, the network is believed to provide improved mechanical properties for a given level of titanium diboride.

It may be useful to increase the total ceramic content of the composite by incorporating a proportion of another ceramic material. Thus, up to 20% by weight of aluminium nitride may be introduced, either as such or by causing the molten metal to react with a suitable amount of oxygen-free nitrogen gas or a reactive compound of nitrogen. An interesting composition contains 60% Al; 25% $TiB_2$; and 15% AlN, all percentages being by weight.

The cermet retains its shape when heated to temperatures substantially above the melting point of aluminium and has considerably better electrical conductivity at high temperatures than solid $TiB_2$, the conductivity essentially being due to the aluminium, whether in solid or liquid state. It has also the further advantage of greater resistance to mechanical shock at normal temperature than solid diboride by reason of the large proportion of aluminium metal, which forms a major proportion of the cermet by volume, and is a continuous phase within the network of ceramic $TiB_2$ (or other boride) particles.

The preferred method of producing the cermet of the invention is by generation of the ceramic phase in situ in the molten metal by chemical reaction with precursor materials introduced into the melt. The fine particles of the ceramic phase tend to form a network at the cell boundaries in the microstructure on subsequent solidification of the metal. The solidified material may desirably be subjected to a heat treatment to allow the ceramic particles to intergrow.

For example it is already known in the production of Al-Ti-B master alloys that $TiB_2$ can be produced as a dispersion of fine particles in an aluminium matrix by adding $K_2TiF_6$ and $KBF_4$ in correct proportions to molten aluminium, where the salts react to form a suspension of very fine solid $TiB_2$ particles and molten potassium fluoaluminates which separate from the aluminium. Typically, such alloys contain Ti added in excess of stoichiometric requirements for formation of $TiB_2$, most or all of such excess dissolving in the molten aluminium at the temperature of addition, and subsequently precipitating on cooling in the form of the intermetallic compound $TiAl_3$. Essentially the same method can be used to produce the composite of the present invention. However in this case larger additions of the two salts in relative proportions to form $TiB_2$ are made with little or no excess Ti as above defined, so that larger quantities of fine $TiB_2$ particles are formed and the molten aluminium loses fluidity by reason of the deposition of $TiB_2$ particles in sufficient quantity to form a network of particles. The operation is preferably carried out in a crucible having the appropriate shape of the desired final component. After the network of diboride particles has been laid down the crucible is preferably held at temperaures to allow the diboride particles to intergrow and increase the mechanical strength of the article. This normally requires a temperature of at least 1100° C. for a typical period of 30 minutes. In some cases it is desirable to heat the formed components while subject to pressure since this may to some extent densify the product and increase the diboride content.

It will be seen that one example of the method of the invention consists in the formation of very fine $TiB_2$ particles in situ in a body of molten aluminium-bearing metal, by reaction of Ti-bearing and B-bearing materials. These materials may be in the form of salts. However one or both of Ti and B may be added in the form of very fine particles or one of Ti and B may already be alloyed with the Al-bearing metal. Thus another method of producing a cermet of the invention can involve reaction of boron-containing salt with Al-Ti alloy. Ti can be introduced to such an alloy in either metallic form as unalloyed Ti or as a T-rich Ti-Al master alloy which may be prepared in a melting furnace or by aluminothermic reduction of $TiO_2$. Alternatively Ti can be introduced by addition of $K_2TiF_6$ as previously mentioned.

It is not necessary to add the boron fluoride in the form of a salt to generate $TiB_2$. Boron can be introduced to an Al-Ti alloy, or indeed any Ti-base alloy or ferrotitanium in the form of gaseous $BF_3$, which can be injected into the melt. However, this method of introducing B is less preferred because B recovery tends to be lower.

It is desirable that the Al-Ti alloy be held above the liquidus temperature prior to the addition of the boron whether in salt or gaseous form such that all Ti is then in solution and reaction to form $TiB_2$ is more complete. This may require the alloy to be at 1200° C. or more, at which temperature loss of boron from the salt in the form of volatile $BF_3$ may occur. For this reason preparation of such as cermet by addition of $KBF_4$ to an Al-Ti alloy is less preferred than the previously mentioned method of adding a mixture of $KBF_4$ and $K_2TiF_6$ which can be effected at a lower temperature of molten Al, and with less loss of alloying ingredients.

Practical difficulty may be encountered in introducing into a body of molten metal a sufficient amount of ceramic precursor. This may arise particularly if the viscosity of the molten metal rises during the introduction to a level at which it can no longer be stirred. While the difficulty can be overcome to some extent by operating at a high temperature, the technique of squeeze casting may also be helpful. This technique, which was described by W. F. Shaw and T. Watmough in "Foundry", October, 1969, involves metering molten metal into a female die cavity and applying pressure directly via an upper or male die during solidification of the cast metal. The metering volume needs to be controlled quite accurately; however, by suitable die or mold design, flow-off channels can be incorporated into convenient areas to allow some degree of flexibility.

When a hot barely fluid composition according to this invention is used as feedstock and the die is provided with flow-off channels, the application of pressure during cooling squeezes out molten metal and leaves behind a composition containing a higher proportion of ceramic material.

The following Examples illustrate the invention.

EXAMPLE 1

One hundred and forty-seven grams of superpurity aluminium were melted in a carbon-bonded, silicon carbide crucible by induction heating and the temperature was stabilized at 1008° C. by reducing the power input. Ninety-six grams of salt were gradually added over a period of 100 seconds. The salt consisted of 44 g of $K_2TiF_6$ and 52 g of $KBF_4$ and was sufficient to produce approximately 7 weight % of $TiB_2$ in the aluminium metal. The induction power was maintained during the salt addition to promote stirring of the metal. The exothermic heat of the reaction brought the temperature up to 1057° C. The power was maintained for 31 minutes after the end of the addition and the temperature during that time lowered to 1040° C. Following the run, the crucible was allowed to air cool to room temperature. The ingot was removed, sectioned and examined metallographically. The ingot was found to contain a large proportion of very fine (>1 micron diameter) $TiB_2$ precipitates. In places where the concentration of precipitates was higher, a connected network of larger grains (10–20 micron diamenter) was formed. No $TiAl_3$, $AlB_2$ or $AlB_{12}$ grains were found. This example establishes that for a practical Al/$TiB_2$ cermet a somewhat greater content of $TiB_2$ is required to establish a continuous coherent $TiB_2$ network.

EXAMPLE 2

The procedure outlined in Example 1 was used in adding 145 g of salt to 67 g of metal. This was designed to produce 20 weight % of $TiB_2$ in aluminium metal. The initial metal temperature was 1000° C. Salt was fed gradually for 6 minutes. The temperature rose to 1170° C. during the reaction and settled back down to 1100° C. during 45 minute heat treatment. The ingot was determined to be solid at 1130° L C. The structure consisted of a connected network of fine $TiB_2$ particles in a matrix of Al. No $TiAl_3$, $AlB_2$ or $AlB_{12}$ grains were evident.

What is claimed is:

1. A cermet material comprising a minor proportion by weight of a ceramic in a major proportion by weight of a metal matrix, characterized in that the material has a microstructure of an intergrown network of the ceramic in the metal matrix.

2. A cermet material as claimed in claim 1, wherein the ceramic content is from 10% to 45% by weight.

3. A cermet material as claimed in claim 1, wherein the metal matrix is one or more of Al, Ti, Cr, V, Nb, Zr, and Hf or an alloy thereof.

4. A cermet material as claimed in claim 1, wherein metal is aluminium or an aluminium alloy and most or all of the ceramic is a diboride of Ti, Zr, Hf, Nb, V or Cr, the ceramic forming an open-cell continuous network the interstices of which are filled with metal.

5. A cermet material as claimed in claim 4, wherein from 20% to 30% of diboride is present.

6. A cermet material as claimed in claim 4, wherein up to 20% by weight of a non-boride ceramic is also present.

7. A cermet material as claimed in claim 1, prepared by forming the ceramic phase in situ in a molten metal phase.

* * * * *